US011383113B2

(12) United States Patent
Holloway

(10) Patent No.: US 11,383,113 B2
(45) Date of Patent: Jul. 12, 2022

(54) PORTABLE FIRE EXTINGUISHER ADAPTED FOR PERSONS WITH DISABILITIES

(71) Applicant: A Shepard's Protection LLC, Woodland Hills, CA (US)

(72) Inventor: Keith L. Holloway, Quartz Hill, CA (US)

(73) Assignee: A Shepard's Protection LLC, Woodland Hills, CA (US)

( * ) Notice: Subject to any disclaimer, the term of this patent is extended or adjusted under 35 U.S.C. 154(b) by 227 days.

(21) Appl. No.: 16/883,499

(22) Filed: May 26, 2020

(65) Prior Publication Data

US 2020/0282245 A1 Sep. 10, 2020

Related U.S. Application Data

(63) Continuation of application No. 16/342,845, filed as application No. PCT/US2018/049376 on Sep. 4, 2018, now Pat. No. 10,702,727.

(Continued)

(51) Int. Cl.
*A62C 13/78* (2006.01)
*A62C 13/64* (2006.01)

(52) U.S. Cl.
CPC ..... *A62C 13/78* (2013.01); *A62C 13/64* (2013.01)

(58) Field of Classification Search
CPC ..... A62C 13/00; A62C 13/64; A62C 13/76; A62C 13/78

(Continued)

(56) References Cited

U.S. PATENT DOCUMENTS 2,506,074 A 11/1946 Fawkes
6,279,664 B1 8/2001 Yanovsky et al.

(Continued)

FOREIGN PATENT DOCUMENTS

JP 2015024919 2/2015

OTHER PUBLICATIONS

International Search Report for PCT/US2018/049376, dated Dec. 18, 2018 (three pages).

(Continued)

*Primary Examiner* — Jason J Boeckmann
(74) *Attorney, Agent, or Firm* — Startup IP Law, LLC; Terrence M. Wyles, Esq.

(57) ABSTRACT

What is disclosed is an improved portable fire extinguisher adapted for persons with disabilities that for one reason or another are unable to effectively use two arms and hands to handle a standard portable fire extinguisher. The fire extinguisher is comprised of the standard main components for a portable fire extinguisher; that is, a gas cylinder, a discharge locking seal and pin, a discharge valve and actuating lever, and a discharge hose/nozzle; plus several hardware enhancements that make it easier for a user to don and use the improved fire extinguisher when the user can only use one hand and/or arm. Those hardware enhancements include an upper-handle actuator-extension member with a large vertical torso-engagement area, pivotable stabilizer arms, a cylinder-mounted retaining strap/collar, neck-strap-anchors and neck strap, a pivotable discharge hose/tube sleeve, and a pivotable stop member for preventing inadvertent actuation.

20 Claims, 6 Drawing Sheets

Related U.S. Application Data

(60) Provisional application No. 62/590,524, filed on Nov. 24, 2017.

(58) Field of Classification Search
USPC ..... 169/71, 30, 88, 89, 75; 222/402.15; 239/375
See application file for complete search history.

(56) References Cited

U.S. PATENT DOCUMENTS

| | | | | |
|---|---|---|---|---|
| 10,350,442 | B2 | 7/2019 | Kronebusch | |
| 2003/0150625 | A1 | 8/2003 | Smith et al. | |
| 2004/0188473 | A1* | 9/2004 | Groh | B65D 83/206 222/402.13 |
| 2008/0245832 | A1 | 10/2008 | Willman | |
| 2013/0014964 | A1 | 1/2013 | Yoshida | |
| 2013/0341369 | A1 | 12/2013 | Kacmarcik | |
| 2016/0175629 | A1 | 6/2016 | Henyan | |
| 2017/0269459 | A1 | 9/2017 | Tipson | |
| 2018/0200549 | A1* | 7/2018 | Fishman | A62C 13/64 |

OTHER PUBLICATIONS

Written Opinion of the International Searching Authority for PCT/US2018/049376, dated Dec. 18, 2018 (five pages).

* cited by examiner

PORTABLE FIRE EXTINGUISHER ADAPTED FOR PERSONS WITH DISABILITIES

CROSS-REFERENCE TO RELATED APPLICATIONS

The present patent application is a continuation of and claims the priority benefit of U.S. patent application Ser. No. 16/342,845, filed on Apr. 17, 2019, for "Improved Portable Fire Extinguisher Adapted for Persons With Disabilities," which in claims the priority benefit of Patent Cooperation Treaty Application No. PCT/US2018/049376, filed on Sep. 4, 2018, for "Improved Portable Fire Extinguisher Adapted for Persons With Disabilities," which claims the priority benefit of U.S. Patent Application No. 62/590,524, filed on Nov. 24, 2017 for "Improved Portable Fire Extinguisher Adapted for Persons With Disabilities." In addition, the present patent application hereby incorporates by reference U.S. patent application Ser. No. 16/342,845, Patent Cooperation Treaty Application No. PCT/US2018/049376, and U.S. Patent Application No. 62/590,524 for all purposes. Should there be any irreconcilable conflicts between disclosures of the present patent application and any of U.S. patent application Ser. No. 16/342,845, Patent Cooperation Treaty Application No. PCT/US2018/049376, and U.S. Patent Application No. 62/590,524, then the disclosures of the present patent application shall govern.

BACKGROUND

More than 43 million Americans have a physical disability of some sort. The National Fire Protection Association (NFPA) has long been involved with developing fire-safety education materials and strategies to accommodate people with disabilities. According to the U.S. Federal Emergency Management Agency (FEMA), from 2007 to 2009, an estimated 700 residential-building fires involved individuals with disabilities were reported annually. Of those reports, only about 8% of the affected residential buildings had full or at least partial automatic fire-suppression systems (mostly sprinkler systems). See "Residential Building Fires Involving Individuals With Physical Disabilities", Topical Fire Report Series, Vol. 12, Issue 6, June 2011.

National Fire-Protection Association (NFPA) Standard 10 establishes requirements for portable fire extinguishers to ensure that portable fire extinguishers will work as intended in order to provide a first line of defense against fires of limited size. However, the NFPA-10 Standards fall short of the requirements set forth by the Americans With Disabilities Act (ADA). For example, under the NFPA standard, the installation-height limit for a portable fire extinguisher, as measured at the handle, is 60 inches (1.5 m) for fire extinguishers weighing more than 40 lb. (18 kg). However, to comply with the ADA, the installation-height limit is 40 inches (1.2 m). Similarly, fire-extinguisher installations are limited under the NFPA standards to no more than four inches of protrusion into the adjacent path of travel in order to protect people with low vision/blindness, which the ADA Rule on this provides for 48 inches to allow access for people in wheelchairs, but is also related to helping other people with disabilities as well.

One area of accommodation for people with disabilities that remains unaddressed pertains with the fact that a typical portable fire extinguisher require that a user employ two hands to effectively use the fire extinguisher. According to the NFPA, when assessing fire risk, it is important to identify vulnerable groups or individuals, including children, the elderly, and those with disabilities. Unfortunately, the standards set by the NFPA and the ADA really only address the needs of persons who are wheelchair-bound and/or are visually impaired/blind. However, even those standards fail to completely address the physical challenges associated with effectively operating a portable fire extinguisher.

The typical portable fire extinguisher is designed such that to use it, two hands and a reasonable amount of strength are required to hold, to pull the safety pin, break the zip-lock tie, then with one hand hold the nozzle while with the other hand squeezing the actuating handle. Unfortunately, some disabled persons who have suffered the loss the use of an arm or hand, an amputation, nerve damage, dislocation, and/or other injury/malady that prevent the use of one of the user's arms or hands will not be able to defend themselves against a fire using a standard portable fire extinguisher.

What is needed is either a redesigned portable fire extinguisher that is adapted to allow use using only one arm and/or a retrofit kit that allows an existing standard portable fire extinguisher to be used with one arm.

BRIEF SUMMARY

The inventive disclosures described herein pertain to an improved portable fire extinguisher adapted for persons with disabilities that for one reason or another are unable to effectively use two arms and hands to handle a standard portable fire extinguisher. In typical embodiments, the improved portable fire extinguisher is comprised of the standard main components for a portable fire extinguisher; that is, a gas cylinder, a discharge locking seal and pin, a discharge valve and actuating lever, and a discharge hose and nozzle; plus several hardware enhancements that make it easier for a user to don and use the improved portable fire extinguisher when the user can only use one hand and arm.

These hardware components include an elongated upper handle that attaches to the aforementioned actuating lever on one end and has a relatively large vertical surface area that is designed to interact with a user's torso such that a user can "hug" into, and/or lean-away from, the vertically inclined handle surface to exercise the actuating lever and valve in order to discharge the fire extinguisher. The longer the vertically inclined handle, the easier it is for a user to use leverage to actuate the fire extinguisher. In variations, the effective torso-engagement surface area of the upper handle is enhanced by two pivotable torso-engagement stabilizer bars. In many embodiments, the improved portable fire extinguisher includes a retaining strap/collar that is bolted/clamped to the cylinder approximately 6-8 inches from the top of the cylinder. This retaining strap/collar is used as an anchor or retention point for several other components, including a pivotable actuation stop that when pivotably engaged with the upper handle's interior vertical surface, prevents the inadvertent fire-extinguisher actuation by a user leaning into the upper handle. In variations, another component that is attached to the retaining strap/collar is a pair of user-neck-strap-attachment members/rings, one disposed on each side of the retaining strap/collar that allows for the secure detachable coupling to a user neck strap, which allows a user to insert his or her head through the neck strap in order to be able to hold onto the fire extinguisher without the use of an arm or hand. Finally, in other variations, the retaining strap/collar also is coupled to a discharge-hose/tube sleeve in which the fire extinguisher's discharge hose is fed through. The discharge-hose/tube sleeve is pivotably coupled to the retaining strap/collar such that a user can adjust the angle of the sleeve to direct discharge without having to hold the discharge tube or nozzle.

In a variation of the embodiments described above, the hardware improvements can be incorporated into a retrofit kit to install on any existing portable fire extinguisher.

The foregoing Brief Summary is intended to merely provide a short, general overview of the inventive disclosure described throughout this patent application, and therefore, is not intended to limit the scope of the inventive disclosure contained throughout the balance of this patent application, including any appended claims and drawings.

BRIEF DESCRIPTION OF THE DRAWINGS

FIG. 1C also provides a call-out bubble that shows the otherwise hidden actuating lever for a typical fire extinguisher, upon which an elongated handle for engaging with a user's torso is attached. It should be noted that the actuating lever is a well-known common component of portable fire extinguishers in the prior art.

FIG. 1G-1 depicts one embodiment of a specialized upper handle with torso-engagement stabilizing bars attached. FIG. 1G-2 depicts one embodiment of a specialized retaining strap/collar with user-neck-strap-attachment members/rings, a pivotable actuation stop/handle lock, and a hinge for attachment to a pivotable discharge-hose sleeve. FIG. 1G-3 depicts one embodiment of a pivotable discharge-hose sleeve.

FIGS. 1H-1, 1H-2, 1H-3, and 1H-4 collectively depict an alternate embodiment of a retaining strap/collar for an improved portable fire extinguisher adapted for use by a disabled person. Specifically, FIG. 1H-1 depicts a top-isometric view of the retaining strap/collar, including a pivotable discharge-hose/tube sleeve and a pivotable actuation stop/handle lock, each with position-locking features in the form of detents adapted to mate with an associated concaved dimple associated with a user-desired position. FIG. 1H-2 depicts a bottom-isometric view of the same retaining strap/collar from FIG. 1H-1. FIG. 1H-3 depicts one embodiment of the hinge-and-position-locking configuration of the pivotable discharge-hose sleeve. Finally, FIG. 1H-4 depicts one embodiment of the hinge-and-position-locking configuration of the pivotable actuation stop/handle lock.

FIG. 2 depicts one embodiment of the improved fire extinguisher depicted in FIG. 1 1A through 1H-4 being donned and used by a person using only one arm.

DETAILED DESCRIPTION

I. Overview

Figure 1A:
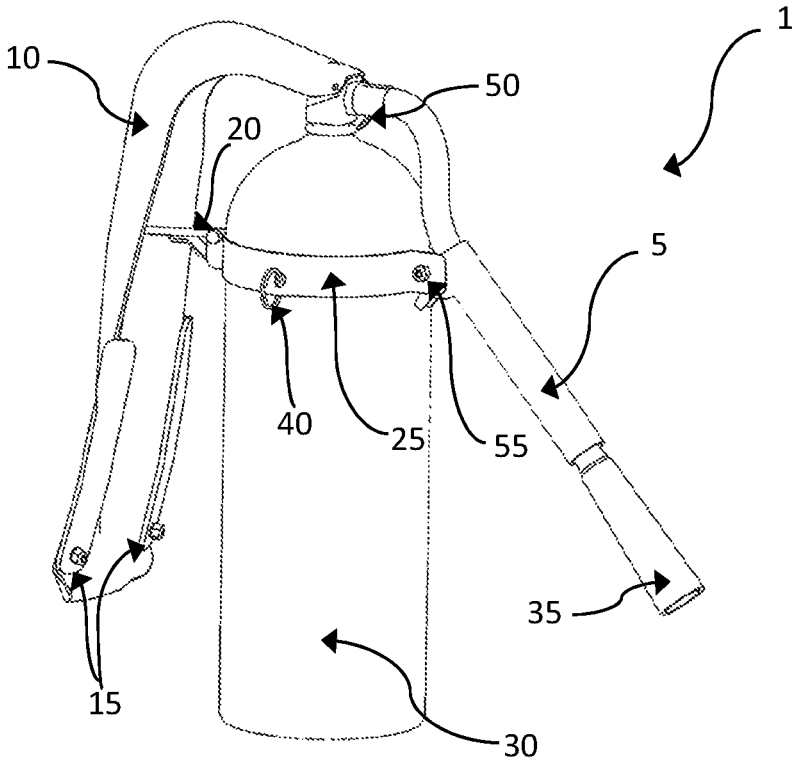
FIG. 1A depicts one embodiment of a right-front isometric view of an improved portable fire extinguisher adapted for use by a disabled person, showing the torso-engagement stabilizing bars on the upper handle in a stowed (not extended) position and its pivotable discharge-hose sleeve extended.
Figure 1B:
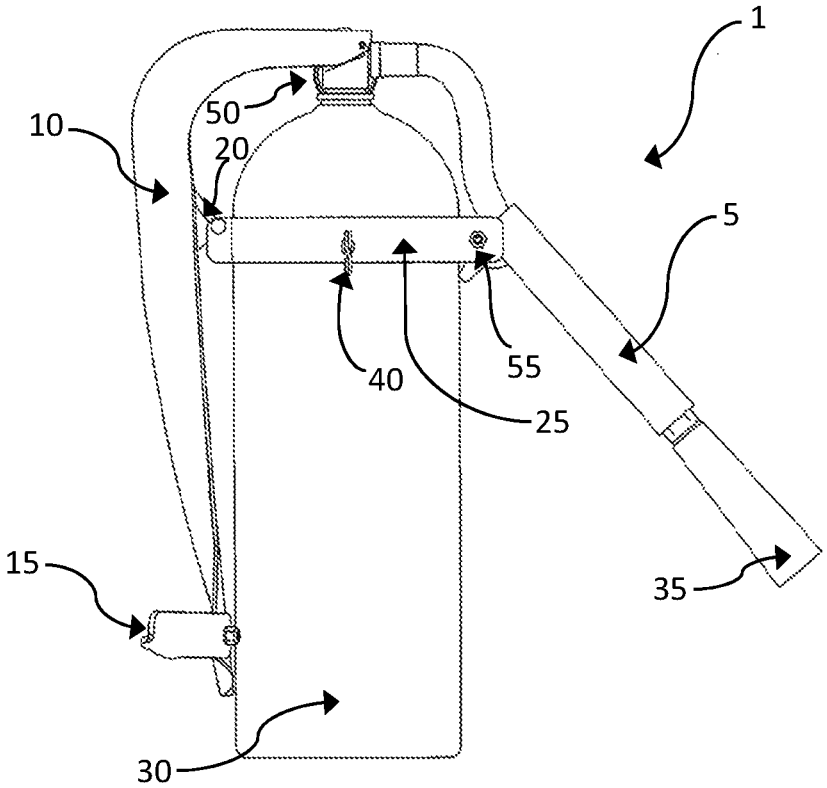
FIG. 1B depicts one embodiment of a right-side view of an improved portable fire extinguisher adapted for use by a disabled person, showing the torso-engagement stabilizing bars on the upper handle extended and its pivotable discharge-hose sleeve extended.

The inventive disclosures described herein pertain to an improved portable fire extinguisher adapted for persons with disabilities that for one reason or another are unable to effectively use two arms and hands to handle a standard portable fire extinguisher. In typical embodiments, the improved portable fire extinguisher is comprised of the standard main components for a portable fire extinguisher; that is, a gas cylinder, a discharge locking seal and pin, a discharge valve and actuating lever, and a discharge hose and nozzle; plus several hardware enhancements that make it easier for a user to don and use the improved portable fire extinguisher when the user can only use one hand and arm.

These hardware components include an elongated upper handle that attaches to the aforementioned actuating lever on one end and has a relatively large vertical surface area that is designed to interact with a user's torso such that a user can "hug" into, and/or lean-away from, the vertically inclined handle surface to exercise the actuating lever and valve in order to discharge the fire extinguisher. The longer the vertically inclined handle, the easier it is for a user to use leverage to actuate the fire extinguisher. In variations, the effective torso-engagement surface area of the upper handle is enhanced by two pivotable torso-engagement stabilizer bars. In many embodiments, the improved portable fire extinguisher includes a retaining strap/collar that is bolted/clamped to the cylinder approximately 6-8 inches from the top of the cylinder. This retaining strap/collar is used as an anchor or retention point for several other components, including a pivotable actuation stop that when pivotably engaged with the upper handle's interior vertical surface, prevents the inadvertent fire-extinguisher actuation by a user leaning into the upper handle. In variations, another component that is attached to the retaining strap/collar is a pair of user-neck-strap-attachment members/rings, one disposed on each side of the retaining strap/collar that allows for the secure detachable coupling to a user neck strap, which allows a user to insert his or her head through the neck strap in order to be able to hold onto the fire extinguisher without the use of an arm or hand. Finally, in other variations, the retaining strap/collar also is coupled to a discharge-hose/tube sleeve in which the fire extinguisher's discharge hose is fed through. The discharge-hose/tube sleeve is pivotably coupled to the retaining strap/collar such that a user can adjust the angle of the sleeve to direct discharge without having to hold the discharge tube or nozzle.

In a variation of the embodiments described above, the hardware improvements can be incorporated into a retrofit kit to install on any existing portable fire extinguisher.

II. Terminology

The terms and phrases as indicated in quotes (" ") in this Section are intended to have the meaning ascribed to them in this Terminology Section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification, drawings, and any appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" and similar phrases in various places in the specification are not necessarily all meant to refer to the same embodiment.

The term "couple" or "coupled", as used in this specification, drawings, and any appended claims, refers to either an indirect or a direct connection between the identified elements, components, or objects. Often, the manner of the coupling is related specifically to the manner in which the two coupled elements interact.

The term "removable", "removably coupled", "readily removable", "readily detachable", "detachably coupled", and similar terms, as used in this specification, drawings, and any appended claims, refer to structures that can be uncoupled from an adjoining structure with relative ease (i.e., non-destructively and without a complicated or time-consuming process) and that can also be readily reattached or coupled to the previously adjoining structure.

Directional and/or relational terms such as, but not limited to, left, right, nadir, apex, top, bottom, vertical, horizontal, back, front, lateral, proximal, and distal are relative to each other, are dependent on the specific orientation of an applicable element or article, are used accordingly to aid in the description of the various embodiments, and are not necessarily intended to be construed as limiting in this specification, drawings, and any appended claims.

As applicable, the terms "about", "approximately", or "generally", as used herein unless otherwise indicated, means a margin of +−20%. Also, as applicable, the term "substantially" as used herein unless otherwise indicated means a margin of +−10%. It is to be appreciated that not all uses of the above terms are quantifiable such that the referenced ranges can be applied.

III. An Improved Portable Fire Extinguisher Adapted for Disabled Persons

This Section III is directed generally to an improved portable fire extinguisher adapted for persons with disabilities that for one reason or another are unable to effectively use two arms and hands to handle a standard portable fire extinguisher. Refer to FIGS. 1A through 1H-4 and FIG. 2.

In typical embodiments, the improved portable fire extinguisher 1 is comprised of the standard main components for a portable fire extinguisher; that is, a gas/fire-retardant-containing cylinder 30, a discharge locking seal and pin, a discharge valve 50 and actuating lever 10A (only depicted in a call-out bubble in FIG. 1C), and a discharge hose and nozzle 35; plus several hardware enhancements that make it easier for a user to don and use the improved portable fire extinguisher 1 when the user can only use one hand and arm.

These added hardware components include an elongated upper handle 10 with a vertically inclined surface that attaches to the upper handle of the aforementioned actuating lever 10A on one end and has a relatively large vertical surface area that is designed to interact with a user's torso such that a user can "hug" the fire extinguisher 1 with a single arm and/or lean-away from, the vertically inclined handle surface attached to the fire extinguisher 1 in order to multiply the leverage available to exercise the actuating lever 10A and valve 50 (or in some cases, the larger handle 10 is fastened [e.g., bolted] in place of the original upper handle 50) to discharge the fire extinguisher 1. The longer the vertically inclined handle 10, the easier it is for a user to use leverage to actuate the fire extinguisher 1. In variations, the effective torso-engagement surface area of the upper handle 10 is enhanced by two pivotable torso-engagement stabilizer bars 15. In many applications, the torso-engagement stabilizer bars 15 are adapted to rotate about 90 degrees from their stowed position along the vertical surface of the upper handle 10. The torso-engagement stabilizer bars 15 help prevent the fire extinguisher 1 from rotating as the user "hugs" into, and/or leans-away from, the fire extinguisher 1 in order to discharge it toward a target fire.

In many embodiments, the improved portable fire extinguisher 1 includes a retaining strap/collar 25 that is bolted/clamped or otherwise fixedly attached to the cylinder 30 approximately 6-8 inches from the top of the cylinder 30. This retaining strap/collar 25 is used as an anchor or retention point for several other components, including a pivotable actuation stop (also called a handle lock) 20 that when pivotably engaged with the upper handle's 10 interior vertical surface, prevents the inadvertent fire-extinguisher 1 actuation by a user exerting force toward the upper handle 10. The pivotable actuation stop/handle lock 20 effectively can take the place of the traditional safety pin and/or zip-lock tie used to lock a standard fire extinguisher, which many disabled persons find difficult to remove/break to enable a fire extinguisher. A user can merely rotate the pivotable actuation stop/handle lock 20 downward to disengage from the upper handle 10 to allow user actuation of the fire extinguisher 1. In some embodiments, the pivotable actuation stop/handle lock 20 can be "locked" into a fixed position by way of mating detents 80 and dimples or holes 75 in the hinge assembly 70, as depicted in FIG. 1H-4.

In variations, another component that is attached to the retaining strap/collar is a pair of user-neck-strap-attachment members/rings 40, one disposed on each side of the retaining strap/collar 25 that allows for the secure detachable coupling to a user neck strap 45, which allows a user to insert his or her head through the neck strap 45 in order to be able to hold onto the fire extinguisher 1 without the use of an arm or hand. In still other variations, the retaining strap/collar 25 also is coupled to a discharge-hose/tube sleeve 5 in which the fire extinguisher's 1 discharge hose 35 is fed through. The discharge-hose/tube holder sleeve 5 is pivotably and tightly coupled to the retaining strap/collar 25 via a hinge 55 such that a user can adjust the angle of the holder sleeve 5 to direct discharge without having to actually hold the discharge tube or nozzle 35 with the user's hand and the sleeve 5 will remain in place. In other variations, the discharge-hose/tube holder sleeve 5 can be "locked" into a user-specified fixed position at the hinge 55, usually via a threaded fastener (not shown), though other locking means known in the art can be employed. For example, in some embodiments, the discharge-hose/tube holder sleeve 5 can be "locked" into a fixed position (e.g., in a 45-degree or 90-degree angle) by way of mating detents 65 and dimples or holes 65 in the hinge assembly 55, as depicted in FIG. 1H-3.

In a variation of the embodiments described above, the hardware improvements described above can be incorporated into a retrofit kit (see FIGS. 1G-1 through 1G-3) to install on any existing portable fire extinguisher.

Figure 1C:
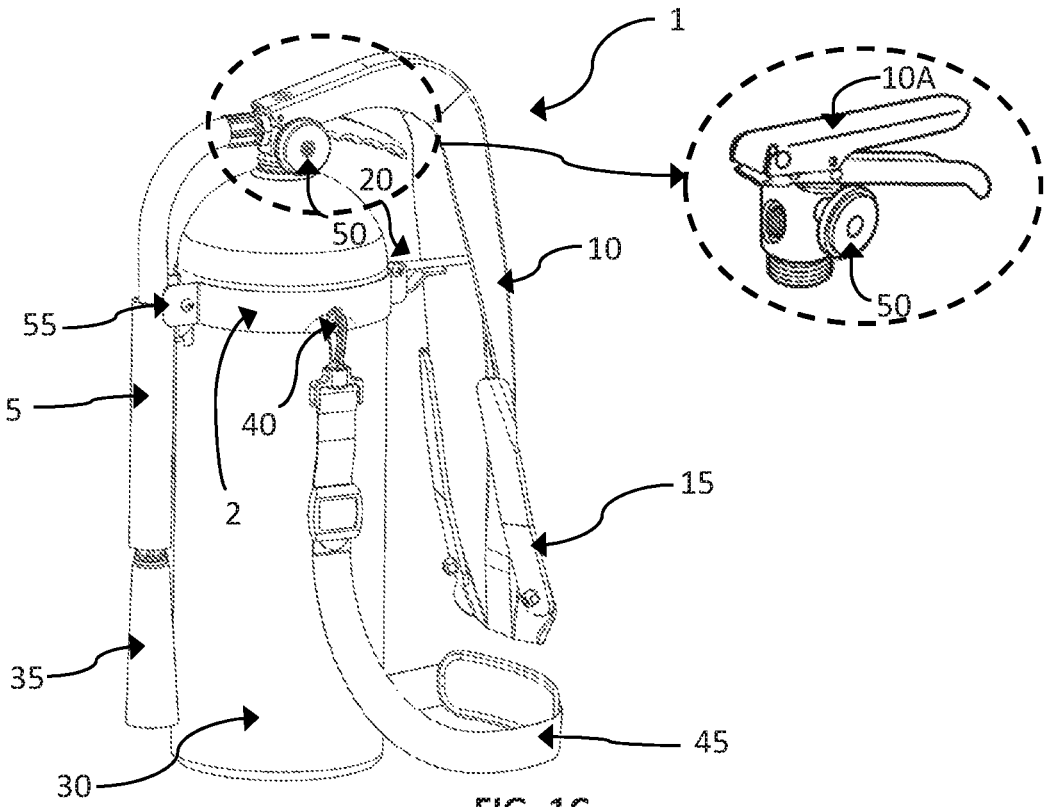
FIG. 1C depicts one embodiment of a left-front isometric view of an improved portable fire extinguisher adapted for use by a disabled person, showing the torso-engagement stabilizing bars on the upper handle in a stowed (not extended) position and its pivotable discharge-hose sleeve shown in its stowed, not-extended position.
Figure 1D:
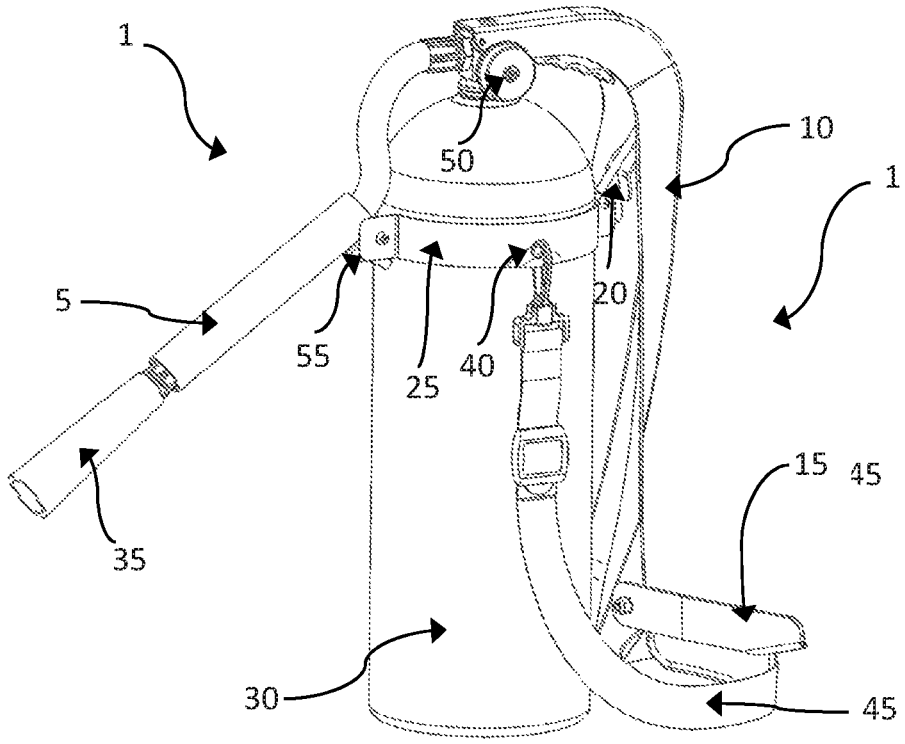
FIG. 1D depicts one embodiment of a left-front isometric view of an improved portable fire extinguisher adapted for use by a disabled person, showing the torso-engagement stabilizing bars on the upper handle extended and its pivotable discharge-hose sleeve extended.
Figure 1E:
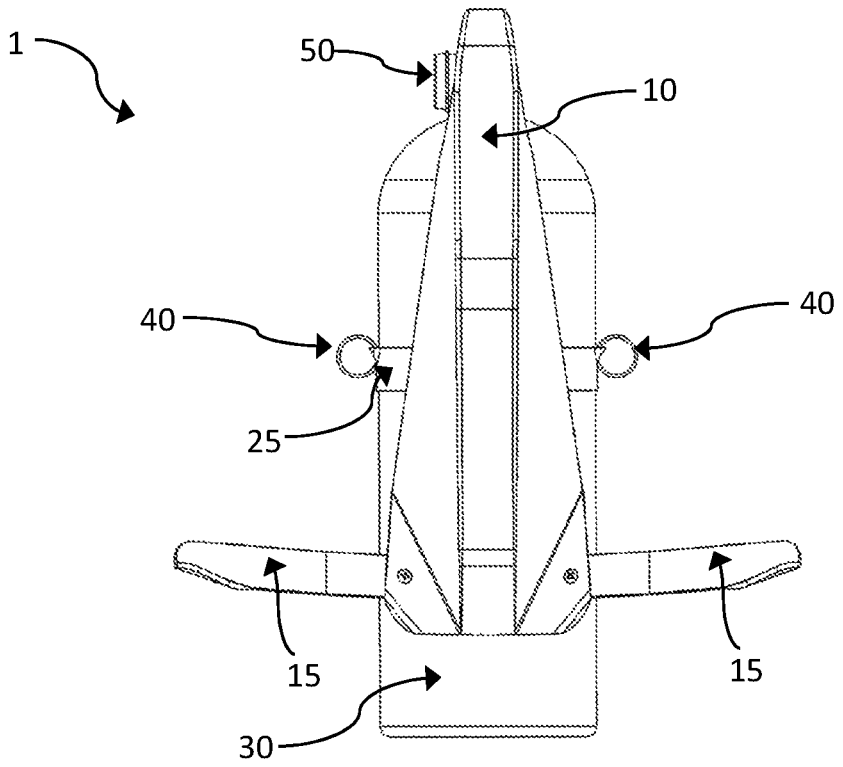
FIG. 1E depicts one embodiment of a rear view of an improved portable fire extinguisher adapted for use by a disabled person, showing the torso-engagement stabilizing bars on the upper handle extended.
Figure 1F:
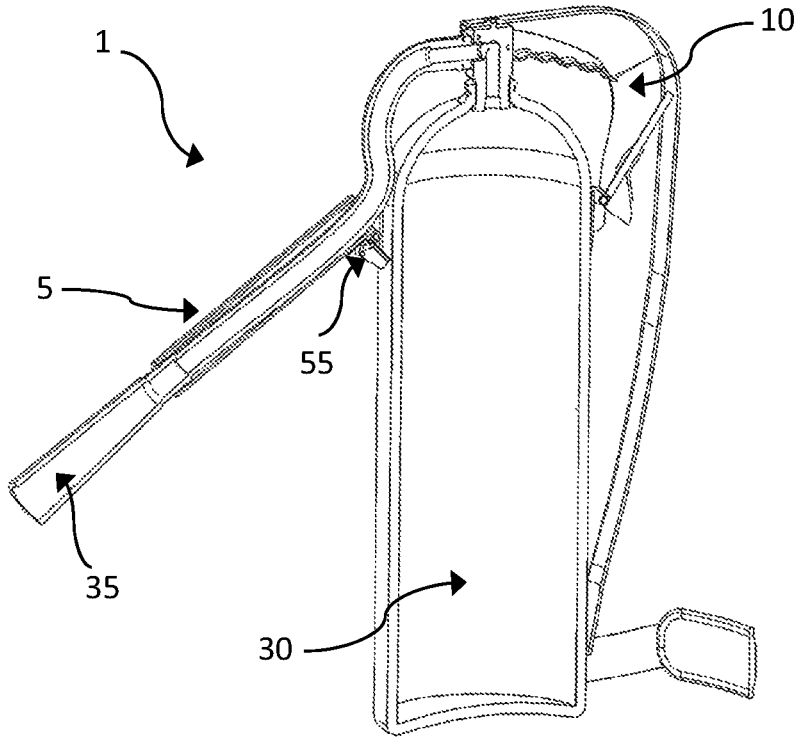
FIG. 1F depicts one embodiment of a left-front isometric view of a cut-away of an improved portable fire extinguisher adapted for use by a disabled person, showing its pivotable discharge-hose sleeve extended.
Figures 1, 1G:
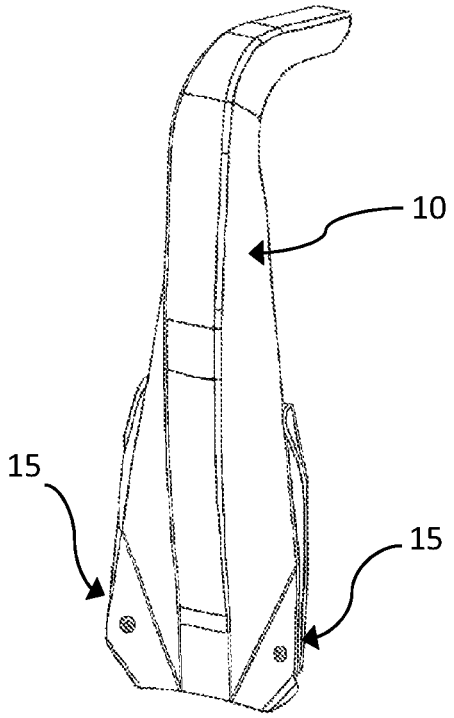
FIGS. 1G-1, 1G-2, and 1G-3 collectively depict one embodiment of depict key components associated with retrofitting a typical fire extinguisher so that the fire extinguisher can be adapted for use by a disabled person.
Figures 1, 1G, 2:
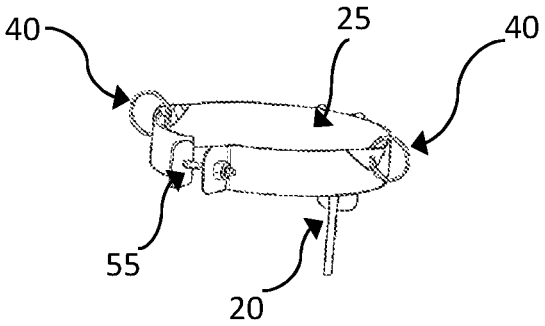
Figures 1, 1G, 2, 3:
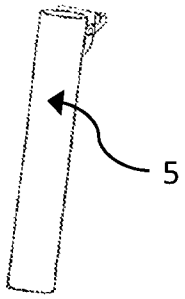
Figures 1, 1H:
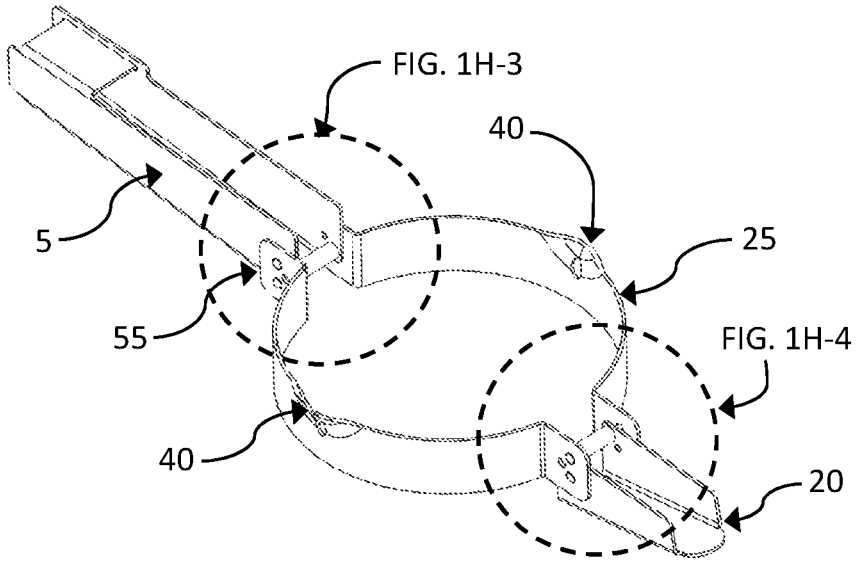
Figures 1, 1H, 2:
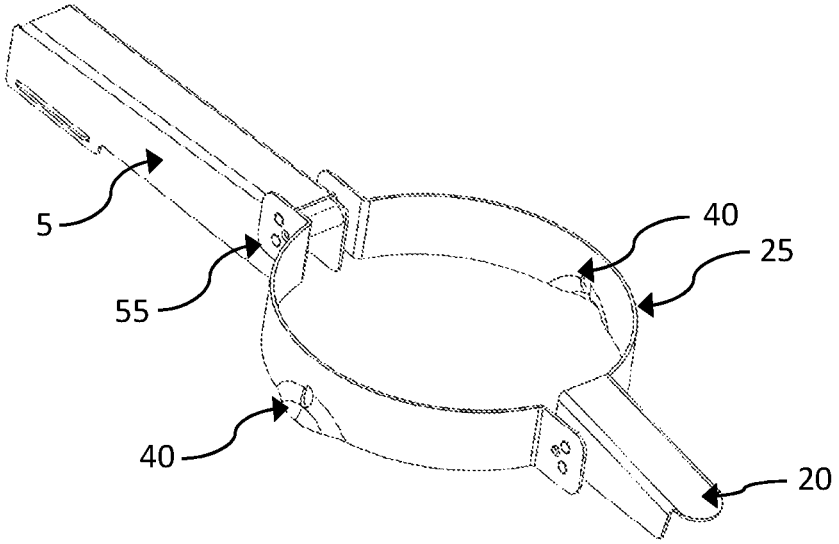
Figures 1, 1H, 2, 3:
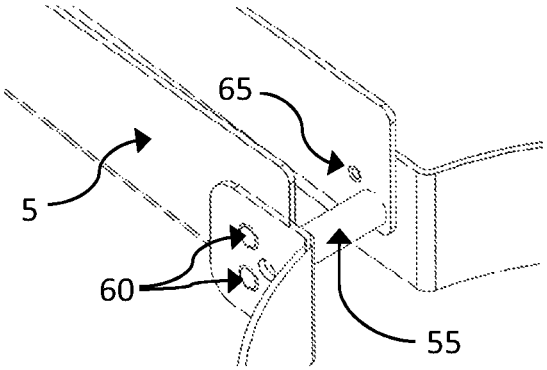
Figures 1, 1H, 2, 3, 4:
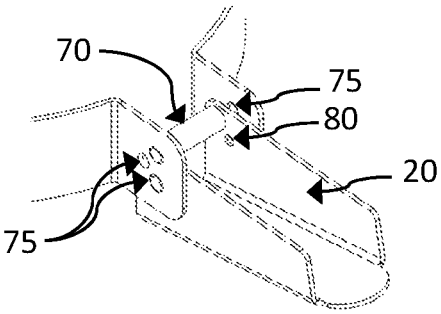
Figure 2:
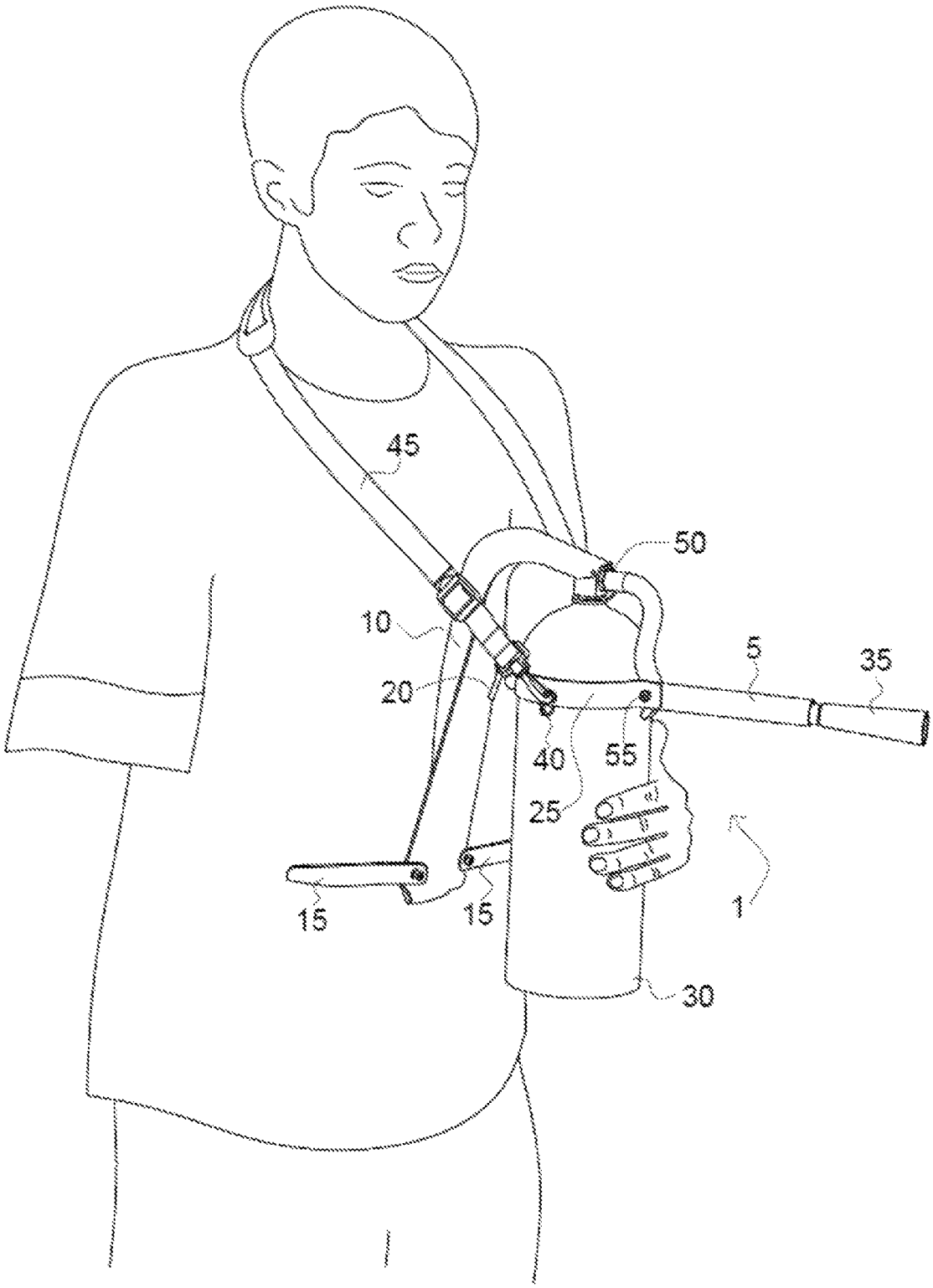

FIG. 2 depicts an embodiment of an improved portable fire extinguisher 1 being donned and used by a person using only one arm.

IV. An Improved Portable Fire Extinguisher Adapted for Persons with Disabilities This Section IV is directed generally to an improved portable fire extinguisher adapted for persons with disabilities that for one reason or another are unable to effectively use two arms and hands to handle a standard portable fire extinguisher. Refer to FIGS. 1A through 1H-4 and FIG. 2.

In an embodiment, the improved portable fire extinguisher 1 comprises a cylinder 30 containing fire retardant and/or gas; a discharge valve 50 with actuating lever 10A (only depicted in a call-out bubble in FIG. 1C); a discharge hose and nozzle assembly 35; and an elongated upper handle 10 with a vertically inclined surface that is coupled to said discharge-valve actuating lever 10A, said elongated upper handle 10 adapted for a user to contact with the user's upper torso such that when pressed against by said user, said fire extinguisher 1 is actuated.

In variations, said elongated upper handle 10 is fastened directly to said discharge valve 50 in place of said actuating lever 10A.

In another modification, at least one pivotable torso-engagement stabilizer bar 15 is rotatably coupled to the lower part of said elongated upper handle 10, wherein said pivotable torso-engagement stabilizer bar 15 can be rotated to be approximately perpendicular to said elongated upper handle 10 in order to increase the effective surface area that said elongated upper handle 10 can contact a user's upper torso when said user "hugs" into and/or leans-away from, the vertically inclined handle 10 surface in order to exercise said actuating lever_10A and discharge valve 50 to discharge said fire extinguisher. In further variations, said at least one pivotable torso-engagement stabilizer bar 15 is actually two such torso-engagement stabilizer bars 15, one disclosed on each side of said elongated upper handle 10.

In more enhancements to this embodiment, the improved fire extinguisher 1 further comprises a retaining collar 25 that is fixedly attached said cylinder 30 in the top-half of said cylinder 30, said retaining collar 25 also comprised of at least two user-neck-strap-attachment members 40 for detachable coupling of a user-donned strap 45 for holding said fire extinguisher 1. In variations, said retaining collar 25 further comprises a pivotable actuation stop 20, said pivotable actuation stop 20 rotatably coupled to said retaining collar 25 and disposed apposite of said upper handle 10; and said pivotable actuation stop 20 can be positioned to point toward said elongated upper handle 10 to prevent inadvertent actuation of said fire extinguisher 1. In some variations, the pivotable actuation stop/handle lock 20 can be "locked" into a fixed position by way of mating detents 80 and dimples or holes 75 in the hinge assembly 70, as depicted in FIG. 1H-4. In even more variations, a discharge-hose sleeve 5 and a hinge 55 are disposed on said retaining collar 25 for coupling to said discharge-hose sleeve 5, with said discharge hose and nozzle assembly 35 fed through said discharge-hose sleeve 5, and said discharge hose and nozzle assembly 35 can be rotatably positioned along the longitudinal axis of said fire extinguisher 1 to aid a user in aiming the discharge of said fire extinguisher 1 when actuated. In still other variations, said discharge-hose sleeve 5 position can be locked into a user-specified position. For example, in some embodiments, the discharge-hose sleeve 5 can be "locked" into a fixed position (e.g., in a 45-degree or 90-degree angle) by way of mating detents 65 and dimples or holes 65 in the hinge assembly 55, as depicted in FIG. 1H-3. Finally, in many variations, a user neck strap 45 is attached to said fire extinguisher 1 via said at least two user-neck-strap-attachment members 40.

V. A Method of Using an Improved Portable Fire Extinguisher Adapted for Disabled Persons This Section V is directed generally to a method of using an improved portable fire extinguisher according to Section III or Section IV, supra, adapted for persons with disabilities that for one reason or another are unable to effectively use two arms and hands to handle a standard portable fire extinguisher. Refer to FIGS. 1A through 1H-4 and FIG. 2.

In an embodiment, the method comprises the steps of:

- by a user, obtaining an improved portable fire extinguisher 1 according to Section III or Section IV, supra;
- by a user, inserting the user's head through said user neck strap 45;
- by a user, exerting force against said elongated upper handle 10 to discharge said fire extinguisher 1.

In variations, the method can be enhanced wherein said elongated upper handle 10 is fastened directly to said discharge valve 50 in place of said actuating lever 10A (only depicted in a call-out bubble in FIG. 1C).

In other variations, the method can be enhanced wherein said improved portable fire extinguisher 1 further comprises at least one pivotable torso-engagement stabilizer bar 15 rotatably coupled to the lower part of said elongated upper handle 15, wherein said at least one pivotable torso-engagement stabilizer bar 15 can be rotated to be approximately perpendicular to said elongated upper handle 10 in order to increase the effective surface area that said elongated upper handle 10 can contact a user's upper torso when said user "hugs" into, and/or leans-away from, said vertically inclined handle 10 surface in order to exercise said actuating lever 10A and discharge valve 50 to discharge said fire extinguisher 1; the method further comprising the step of:

- by a user, rotating said at least one pivotable torso-engagement stabilizer bar 15 to be approximately perpendicular to said elongated upper handle 10 to effectively increase the surface area in contact with the user's torso.

In related variations, said at least one pivotable torso-engagement stabilizer bar 15 is two such torso-engagement stabilizer bars 15, one disclosed on each side of said elongated upper handle 10.

In even more variations, the method can be enhanced wherein said retaining collar 25 further comprises a pivotable actuation stop 20, said pivotable actuation stop 20 rotatably coupled to said retaining collar 25 and disposed apposite of said elongated upper handle 10; and said pivotable actuation stop 20 can be positioned to point toward said elongated upper handle 10 to prevent inadvertent actuation of said fire extinguisher 1; the method further comprising the step of:

rotating said pivotable actuation stop down or up such that it no longer prevents the torso-pressing of said elongated upper handle, thus enabling the discharge capability of said fire extinguisher.

In some variations, said pivotable actuation stop/handle lock 20 can be "locked" into a fixed position by way of mating detents 80 and dimples or holes 75 in the hinge assembly 70, as depicted in FIG. 1H-4.

In additional variations, the method can be further enhanced wherein said retaining collar 25 further comprises a discharge-hose sleeve 5 and a hinge 55 disposed on said retaining collar 55, with said discharge hose and nozzle assembly 35 fed through said discharge-hose sleeve 5, and said discharge hose and nozzle assembly 35 can be rotatably positioned along the longitudinal axis of said fire extinguisher 1 to aid a user in aiming the discharge of said fire extinguisher 1 when actuated; the method further comprising the step of:

by a user, rotating said discharge-hose sleeve up or down to a user-specified position.

In other variations, the method can be further enhanced wherein said discharge-hose sleeve 5 position can be locked into a user-specified position, the method further comprising the step of:

by a user, locking said discharge-hose sleeve in a user-specified position.

In some variations, the discharge-hose sleeve 5 can be "locked" into a fixed position (e.g., in a 45-degree or 90-degree angle) by way of mating detents 65 and dimples or holes 65 in the hinge assembly 55, as depicted in FIG. 1H-3.

VI. A Kit for Retrofitting a Portable Fire Extinguisher to be More-Usable by a Disabled Person This Section VI is directed generally to a kit for retrofitting an existing portable fire extinguisher having a cylinder containing fire retardant and/or gas, a discharge valve with actuating lever, and a discharge hose and nozzle assembly. so that persons with impaired abilities in at least one arm/hand can still effectively operate the retrofitted fire extinguisher. Refer to Refer to FIGS. 1A through 1H-4 and FIG. 2, with emphasis on FIGS. 1G-1 through 1G-3.

In an embodiment, the fire-extinguisher retrofit kit comprises an elongated upper handle 10 with a vertically inclined surface that can be coupled to a fire extinguisher's discharge-valve actuating lever 10A (only depicted in a call-out bubble in FIG. 1C), said elongated upper handle 10 adapted for a user to contact with the user's upper torso such that when force is exerted by said user, said fire extinguisher 1 is actuated.

In variations, said elongated upper handle 10 is adapted to be fastened directly to said discharge valve 50 in place of said actuating lever 10A.

In additional variations, said elongated upper handle 10 further comprises at least one pivotable torso-engagement stabilizer bar 15 rotatably coupled to the lower part of said elongated upper handle 10, wherein said pivotable torso-engagement stabilizer bar 15 can be rotated to be approximately perpendicular to said elongated upper handle 10 in order to increase the effective surface area that said elongated upper handle 10 can contact a user's upper torso when said user "hugs" into, and/or leans-away from, said vertically inclined handle 10 surface in order to exercise said actuating lever 10A and discharge valve 50 to discharge said fire extinguisher 1.

In some variations, said at least one pivotable torso-engagement stabilizer bar 15 is two such torso-engagement stabilizer bars 15, one disclosed on each side of said elongated upper handle 10.

In still more variations, the kit further comprises a retaining collar 25 that can be fixedly attached said cylinder 30 in the top-half of said cylinder 30, said retaining collar 25 also comprised of at least two user-neck-strap-attachment members 40 for detachable coupling of a user-donned strap 45 for holding said fire extinguisher 1.

In some variations, the kit's retaining collar 25 further comprises a pivotable actuation stop 20, wherein said pivotable actuation stop 20 is rotatably coupled to said retaining collar 25 and when said retaining collar 25 is installed on said cylinder 30, said pivotable actuation stop 20 is disposed apposite of said elongated upper handle 10; and said pivotable actuation stop 20 can be positioned to point toward said elongated upper handle 10 to prevent inadvertent actuation of said fire extinguisher 1.

In still more variations, the kit further comprises a discharge-hose sleeve 5 and a hinge 55 that can be coupled to said retaining collar 25, wherein a fire extinguisher's discharge hose and nozzle assembly 35 can be fed through said discharge-hose sleeve 5 and said discharge hose and nozzle assembly 35 can be rotatably positioned along the longitudinal axis of an attached fire extinguisher 1 to aid a user in aiming the discharge of said fire extinguisher 1 when actuated. In a modification, said discharge-hose sleeve 5 position can be locked into a user-specified position. In some variations, the discharge-hose sleeve 5 can be "locked" into a fixed position (e.g., in a 45-degree or 90-degree angle) by way of detents 65 disposed in said discharge-hose sleeve 5 and positioned and sized mate with pre-positioned dimples 60 or holes in a hinge bracket 55.

Finally, in another variation, the kit further comprises a user neck strap 45 that can be connected to said user-neck-strap-attachment members 40 disposed on said retaining collar 25.

VII. Alternative Embodiments and Other Variations

The various embodiments and variations thereof described herein, including the descriptions in any appended Claims and/or illustrated in the accompanying Figures, are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising myriad obvious variations and improvements to the invention, all of which are intended to be encompassed within the scope of the Description, Figures, and Claims herein.

What is claimed is:

1. An improved portable fire extinguisher, adapted for use by persons with disabilities to one or more of their upper extremities, comprising:

a cylinder containing fire retardant and/or gas, said cylinder having a top and a bottom, with a longitudinal surface disposed between said top and bottom;

a discharge valve with actuating lever, external to said cylinder, said discharge valve disposed at the top of said cylinder;

a discharge hose and nozzle assembly, external to said cylinder; and an elongated upper handle that is either coupled to an actuating lever attached to said discharge-valve or directly coupled to said discharge valve, said elongated upper handle having a substantially vertically inclined surface extending at least partially down the longitudinal surface of said cylinder wherein:

said substantially vertically inclined surface is wider toward the bottom of said elongated upper handle as compared to the top of said elongated upper handle, said elongated upper handle adapted for a user to contact with the user's upper torso such that when said user hugs into said elongated upper handle, and said elongated upper handle pivots relative to said cylinder to cause said fire extinguisher discharge valve to open, and when said user leans-away from said elongated upper handle, said elongated upper handle pivots relative to said cylinder to cause said discharge valve to close.

2. The improved portable fire extinguisher of claim 1, further comprising at least one pivotable torso-engagement stabilizer bar rotatably coupled to the lower part of said elongated upper handle, wherein:

said pivotable torso-engagement stabilizer bar can be rotated to be approximately perpendicular to said elongated upper handle in order to increase the effective surface area that said elongated upper handle can contact a user's upper torso when said user hugs into and/or leans-away from said vertically inclined handle surface in order to exercise said actuating lever and discharge valve to discharge said fire extinguisher.

3. The improved portable fire extinguisher of claim 2, wherein said at least one pivotable torso-engagement stabilizer bar is two such torso-engagement stabilizer bars, one disclosed on each side of said elongated upper handle.

4. The improved portable fire extinguisher of claim 1, further comprising a retaining collar that is fixedly attached said cylinder in the top-half of said cylinder, said retaining collar also comprised of at least two user-neck-strap-attachment members for detachable coupling of a user-donned strap for holding said fire extinguisher.

5. The improved portable fire extinguisher of claim 4, wherein:

said retaining collar further comprises a pivotable actuation stop, said pivotable actuation stop being rotatably coupled to said retaining collar and disposed apposite of said elongated upper handle; and said pivotable actuation stop can be positioned to point toward said elongated upper handle to prevent inadvertent actuation of said fire extinguisher.

6. The improved portable fire extinguisher of claim 5, further comprising a discharge-hose sleeve and a hinge disposed on said retaining collar for coupling to said discharge-hose sleeve, with said discharge hose and nozzle assembly fed through said discharge-hose sleeve, wherein said discharge hose and nozzle assembly can be rotatably positioned along the longitudinal axis of said fire extinguisher to aid a user in aiming the discharge of said fire extinguisher when actuated.

7. The improved portable fire extinguisher of claim 6, wherein said discharge-hose sleeve position can be locked into a user-specified position.

8. The improved portable fire extinguisher of claim 7, wherein said locking of said discharge-hose sleeve rotation position is accomplished by way of detents disposed in said discharge-hose sleeve and positioned and sized to mate with pre-positioned dimples or holes in a hinge bracket.

9. The improved portable fire extinguisher of claim 5, further comprising a user neck strap to allow a user to insert the user's head through said neck strap in order to be able to hold onto said fire extinguisher without the use of one arm or hand.

10. A kit for retrofitting a portable fire extinguisher to be more-usable by a disabled person with disabilities to one or more of upper extremities; said fire extinguisher having a cylinder containing fire retardant and/or gas, said cylinder having a top and a bottom with a longitudinal surface disposed between said top and bottom; a discharge valve with actuating lever, external to said cylinder, said discharge valve disposed at the top of said cylinder; and a discharge hose and nozzle assembly, external to said cylinder; said kit comprising:

an elongated upper handle that is either adapted to be coupled to an actuating lever attached to said discharge-valve or adapted to be directly coupled to said discharge valve, said elongated upper handle having a substantially vertically inclined surface extending at least partially down the longitudinal surface of said cylinder wherein:

said substantially vertically inclined surface is wider toward the bottom of said elongated upper handle as compared to the top of said elongated upper handle, said elongated upper handle adapted for a user to contact with the user's upper torso such that when said user hugs into said elongated upper handle, and said elongated upper handle pivots relative to said cylinder to cause said fire extinguisher discharge valve to open, and when said user leans-away from said elongated upper handle, said elongated upper handle pivots relative to said cylinder to cause said discharge valve to close.

11. The kit of claim 10, wherein said elongated upper handle further comprises at least one pivotable torso-engagement stabilizer bar rotatably coupled to the lower part of said elongated upper handle, wherein:

said pivotable torso-engagement stabilizer bar can be rotated to be approximately perpendicular to said elongated upper handle in order to increase the effective surface area that said elongated upper handle can contact a user's upper torso when said user hugs into and/or leans-away from said vertically inclined handle surface in order to exercise said actuating lever and discharge valve to discharge said fire extinguisher.

12. The kit of claim 11, wherein said at least one pivotable torso-engagement stabilizer bar is two such torso-engagement stabilizer bars, one disclosed on each side of said elongated upper handle.

13. The kit of claim 10, further comprising a retaining collar that can be fixedly attached said cylinder in the top-half of said cylinder, said retaining collar also comprised of at least two user-neck-strap-attachment members for detachable coupling of a user-donned strap for holding said fire extinguisher.

14. The kit of claim 13, wherein:

said retaining collar further comprises a pivotable actuation stop, wherein:

said pivotable actuation stop being rotatably coupled to said retaining collar and when said retaining collar is installed on said cylinder, said pivotable actuation stop is disposed apposite of said elongated upper handle; and said pivotable actuation stop can be positioned to point toward said elongated upper handle to prevent inadvertent actuation of said fire extinguisher.

15. The kit of claim 14, further comprising a discharge-hose sleeve and a hinge that can be coupled to said retaining collar, wherein:

a fire extinguisher's discharge hose and nozzle assembly can be fed through said discharge-hose sleeve; and said discharge hose and nozzle assembly can be rotatably positioned along the longitudinal axis of an attached fire extinguisher to aid a user in aiming the discharge of said fire extinguisher when actuated.

16. The kit of claim 15, wherein said discharge-hose sleeve position can be locked into a user-specified position.

17. The kit of claim 16, wherein said locking of said discharge-hose sleeve rotation position is accomplished by way of detents disposed in said discharge-hose sleeve and positioned and sized to mate with pre-positioned dimples or holes in a hinge bracket.

18. The kit of claim 13, further comprising a user neck strap that can be connected to said user-neck-strap-attachment members disposed on said retaining collar.

19. A method of using an improved portable fire extinguisher according to claim 9, comprising the steps of:

by a user, obtaining an improved portable fire extinguisher according to claim 9;

by a user, inserting the user's head through said user neck strap;

by a user, with said elongated upper handle in contact with said user's torso, hugging into and/or leaning-away from said elongated upper handle to discharge said fire extinguisher.

20. The method of claim 19, the method further comprising the step of:

by a user, rotating said at least one pivotable torso-engagement stabilizer bar to be approximately perpendicular to said elongated upper handle to effectively increase the surface area in contact with the user's torso.

* * * * *